United States Patent [19]

Guenther

[11] Patent Number: 4,534,563

[45] Date of Patent: Aug. 13, 1985

[54] THREE DIMENSIONAL PUZZLE

[76] Inventor: Geoffrey L. Guenther, 26834 Hyte Rd., Rancho Palos Verdes, Calif. 90274

[21] Appl. No.: 539,481

[22] Filed: Oct. 6, 1983

[51] Int. Cl.[3] ..... A63F 9/12

[52] U.S. Cl. ..... 273/157 R; 273/160

[58] Field of Search ..... 273/156, 157 R, 160; 434/211

[56] References Cited

U.S. PATENT DOCUMENTS 4,153,254 5/1979 Marc ..... 273/160

FOREIGN PATENT DOCUMENTS 1154 of 1906 United Kingdom ..... 273/160

OTHER PUBLICATIONS

"Polyominoes" by Solomon W. Golomb, Publ. by Charles Scribners Sons, N.Y., Copyright 1965, pp. 116, 117 and 158.

*Primary Examiner*—Anton O. Oechsle

*Attorney, Agent, or Firm*—Irving Keschner

[57] ABSTRACT

A three dimensional puzzle game having a plurality of component pieces, which when assembled, form a plurality of different right rectangular prism solution shapes. The pieces are designed to give a puzzle unit volume which is a multiple of at least four prime numbers, not all equal to each other. All of the component pieces are utilized to provide each of the solution shapes. Preferably, the component pieces are multi-layered and made from rectangular cross-section material, such as wood, of uniform width.

9 Claims, 6 Drawing Figures

THREE DIMENSIONAL PUZZLE

BACKGROUND OF THE INVENTION

In today's inflationary and stressful society, recreational diversions from one's work or school obligations are constantly being sought. However, many of these diversions are increasingly expensive, such as personal home computers, stereo equipment, sports equipment, etc. Many families and individuals are seeking less expensive means of entertainment that can be enjoyed both in and out of the home. For these reasons, puzzles and games which provide stimulating competition to a player are enjoying continuing popularity.

Three dimensional puzzles have existed for a number of years, the early puzzles often being limited by their lack of versatility or competitive complexity. A number of these three dimensional puzzles are available in which the pieces may be assembled in numerous ways to form a single desired polyhedron. Typical of this type of puzzle is that commonly marketed under the trademark "Soma Cube." There are a number of possible solutions, each requiring the use of all the component pieces.

U.S. Pat. No. 4,153,254 to Marc discloses a three dimensional puzzle having a plurality of components, which when assembled form a polyhedron of a specific volume. Polyhedrons of different volumes may be formed by assembling a quantity of puzzle components less than the total quantity. Although ten component pieces are contained in the puzzle, one puzzle solution utilizes all ten component pieces, another component puzzle solution uses seven specific component pieces from the total of ten provided, and another embodiment is provided wherein only six component pieces of the ten components provided are utilized to provide a puzzle (cubic) solution. One of the drawbacks to the Marc puzzle configuration is that the component pieces are complex in shape indicating that the puzzle will be relatively costly to fabricate and thus, in turn, expensive to the consumer.

U.S. Pat. No. 3,065,970 to Besley discloses a puzzle which comprises a plurality of similarly shaped interfitting pieces which can be arranged to form aggregate structures. Each of the pieces are made up of a series of cubes, some of the pieces being relatively complicated to fabricate. As in the Marc patent, certain of the puzzle configurations use less than all of the puzzle pieces.

Other patents which relate to puzzle games or three dimensional assemblies include U.S. Pat. No. 3,546,792 to Sherman; U.S. Pat. No. 3,801,105 to Soubrier; U.S. Pat. No. 4,177,993 to Crosby et al; U.S. Pat. No. 3,924,376 to Tsurumi; U.S. Pat. No. 2,836,421 to Turner; U.S. Pat. No. 2,473,369 to Harris; U.S. Pat. No. 1,455,009 to Schenk; U.S. Pat. No. 1,225,760 to Brown; U.S. Pat. No. 1,100,828 to Heard; and U.S. Pat. No. 1,189,527 to Barnhart.

Although various three dimensional puzzles have been available in the prior art for many years as evidenced by the above referenced patents, it still would be desirable if a three dimensional puzzle which is relatively inexpensive to fabricate and which yet still challenges the interest and skills of puzzle players of various levels of skill, would be provided. Further, it would be desirable and more challenging if all of the component pieces provided in the puzzle are necessary to provide different puzzle solution shapes.

SUMMARY OF THE INVENTION

The present invention provides a three dimensional puzzle, in which a variety of pieces may be assembled into two or more right rectangular prisms. The pieces are designed to give a total puzzle unit volume which is a multiple of at least four prime numbers, not all equal to each other. The puzzle unit volume is defined as the product of the number of layers in the solution times the width times the length, divided by the square of the uniform width of the material. In a particular embodiment illustrated, the puzzle unit volume is designed to be equal to 72; the prime factors thus being 2, 2, 2, 3, and 3. Eight or more distinct right rectangular prism solution shapes are thus theoretically possible, of various length-to-width-to-height prime factor combinations. The pieces may be assembled into solutions other than right rectangular prisms and more than one way of assembling each shape may also exist.

Thus in contradistinction to the aforementioned prior art patents, it is possible to provide a number of unique puzzle solutions utilizing all the puzzle pieces which adds another level of complexity and challenge to the puzzle player. Further, in the preferred embodiment, each component piece is multilayered and made from rectangular cross section material of uniform width, the resulting shapes of each component piece being relatively simple, the fabrication process therefore thus being relatively simple and cost effective. Although the component pieces are relatively simple and inexpensive to make, a variety of relatively complex challenges will be presented to the puzzle player. The fact that all the component pieces are utilized to assemble different puzzle solutions allows the puzzle to be packaged aesthetically in a choice of configurations.

BRIEF DESCRIPTION OF THE DRAWINGS

The foregoing aspects and other features of the invention are explained and the following description is taken in conjunction with the accompanying drawings wherein.

DETAILED DESCRIPTION OF THE INVENTION

The present invention consists of a three-dimensional puzzle, or class of puzzles, in which a variety of multilayer pieces, in the preferred embodiment, made from rectangular cross section material of uniform width adhesively joined together, may be assembled into two or more right rectangular prisms. The assembled component pieces are designed to give a total puzzle unit volume (defined hereinafter) which is a multiple of at least four prime numbers, not all equal to each other.

By designing the puzzle on the basis of multiple combinations of the prime number factors, a number of puzzle solutions can be provided, each different puzzle solution utilizing each of the component pieces. Puzzle unit volume, for the purposes of the present invention, is defined as the product of the number of layers in the particular puzzle solution, times the total width, times the total length divided by the square of the uniform width of the material. Note that this definition is for purposes of convenience since the unit component piece is rectangular in width.

For the puzzle solutions shown in FIGS. 1–6, a puzzle unit volume of 72 is arbitrarily selected. The prime numbers, or factors, are 2, 2, 2, 3, and 3. Eight or more distinct right rectangular prism solution shapes are theoretically possible of length—to width—to height factor combinations as follows (lengths and widths of two or less have been omitted as trivial):

(a) 3:3×2×2:2 that is, 3×12×2
(b) 2×2:3×3:2 that is, 4×9×2
(c) 3×2:3×2:2 that is, 6×6×2
(d) 3:3×2:2×2 that is, 3×6×4
(e) 3:2×2:3×2 that is, 3×4×6
(f) 3:3:2×2×2 that is, 3×3×8
(g) 3:2×2×2:3 that is, 3×8×3
(h) 3×2:2×2:3 that is, 6×4×3

Note for example that solution (c) is obtained from solution (a) by simply recombining a prime number 2 from the width column to the length column.

To illustrate another example of providing puzzle solutions by selecting a puzzle unit volume, prime numbers 2, 2, 2, and 3 result from selecting a volume of 24 (note that the instant invention requires at least four prime numbers). In this case it can be shown that three solutions (3×4×2, 2×3×4, and 6×2×2) using all the component pieces are theoretically possible.

Figure 1:
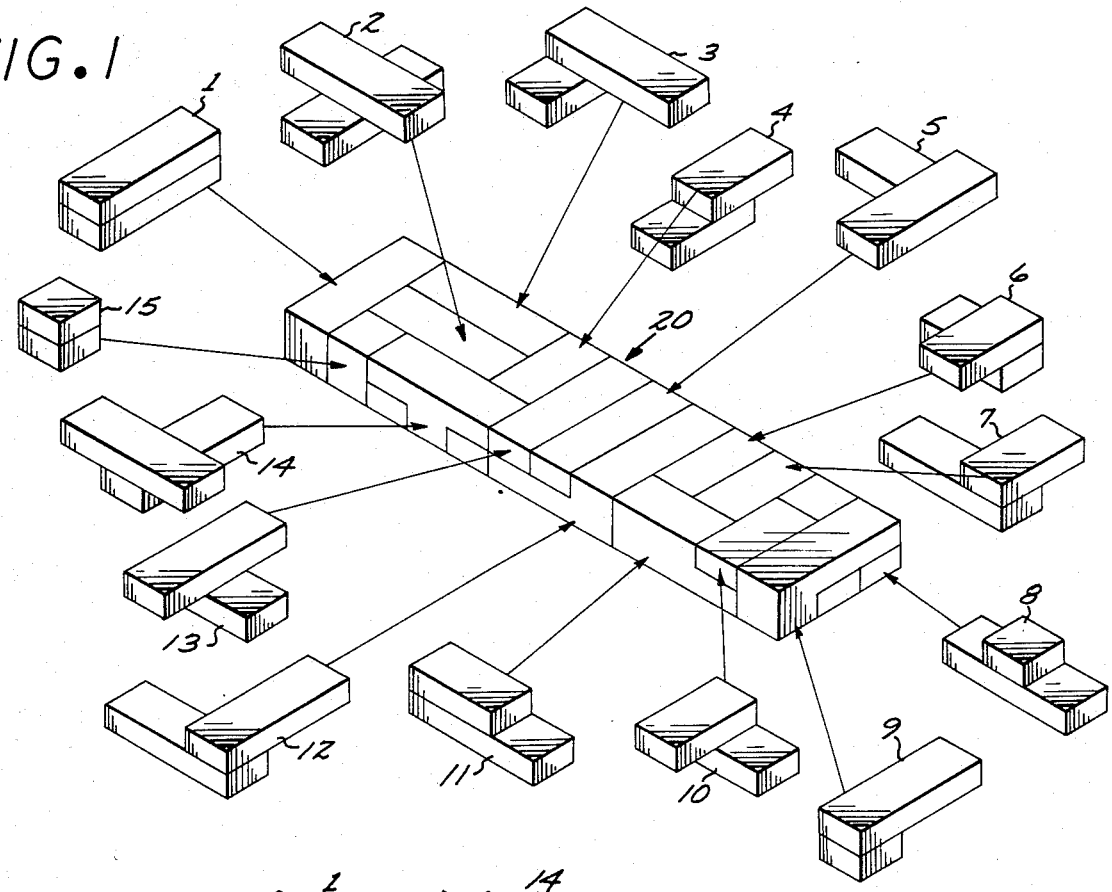
FIG. 1 is a perspective view of a $3\times12\times2$ size puzzle with an exploded view of each of the components.

FIG. 1 shows a perspective and exploded view of one puzzle solution in accordance with the teachings of the present invention. Shown are component pieces 1 through 15 which when properly arranged form a right rectangular prism shape 20. The component pieces 1 through 15 may be made of any suitable material such as wood, plastic, or metal. Each component comprises a multi-layer arrangement made from a rectangular cross section material of uniform width. It should be noted that pieces 1 through 15 could be a monoblock, or integrated structure, of two levels made of injection molded plastic. The component piece 1 comprises two aligned layers each, three units (in the specific example illustrated a single unit is 0.750 inches long, 0.750 inches wide and 0.281 high) in length; puzzle piece 2 comprises an upper layer three units long crossing at right angles, a lower layer three units long; puzzle piece 3 comprises a three unit long upper layer joined at the corner of a two unit long lower layer as shown; puzzle piece 4 comprises a two unit long upper layer joined at the corner of a two unit long lower layer as shown; puzzle piece 5 comprises a three unit long upper layer joined at the corner of a three unit long lower layer as shown; puzzle piece 6 comprises a two unit long upper layer joined at the corner of a two unit long lower layer as shown; puzzle piece 7 comprises a two unit long upper layer joined at the corner of a three unit long lower layer as shown; puzzle piece 8 comprises a one unit long upper layer joined at the middle of a three unit long lower layer as shown; puzzle piece 9 comprises a three unit long upper layer joined at the corner of a one unit long lower layer as shown; puzzle piece 10 comprises a two unit upper layer joined at the corner of a two unit lower layer as shown; puzzle piece 11 comprises a two unit upper layer joined at the corner of a three unit lower layer as shown; puzzle piece 12 comprises a three unit upper layer joined at the corner of a three unit lower layer as shown; puzzle piece 13 comprises a three unit long upper layer joined at right angles to a two unit long lower layer in the form of a "tee" as shown; puzzle piece 14 comprises a three unit long upper layer joined at right angles to a three unit long lower layer in the form of a "tee" as shown; and puzzle piece 15 comprises two one unit long layers joined as shown. The layers of each piece are adhesivelv joined together with a wood glue and each piece has its edges finished in such a manner as to enable the pieces to fit easily together. Such finishing techniques are known to those skilled in the art. To form the 3×12×2 rectangular prism, shown in FIG. 1, each component must be distinctly arranged in relation to the other components so that all 15 component pieces are used. An error in judgment of just one component piece will prevent a player from successfully completing the shape shown in FIG. 1.

The calculation of puzzle unit volume for the FIG. 1 solution is as follows: the number of layers (2) times the total width (3″×¾″)times the total length (12″×¾″) divided by the square of the uniform width of the material (¾″×¾″) equals 72. The same volume results by multiplying the number of height units (2), the number of length units (12) and the number of width units (3).

Figure 2:
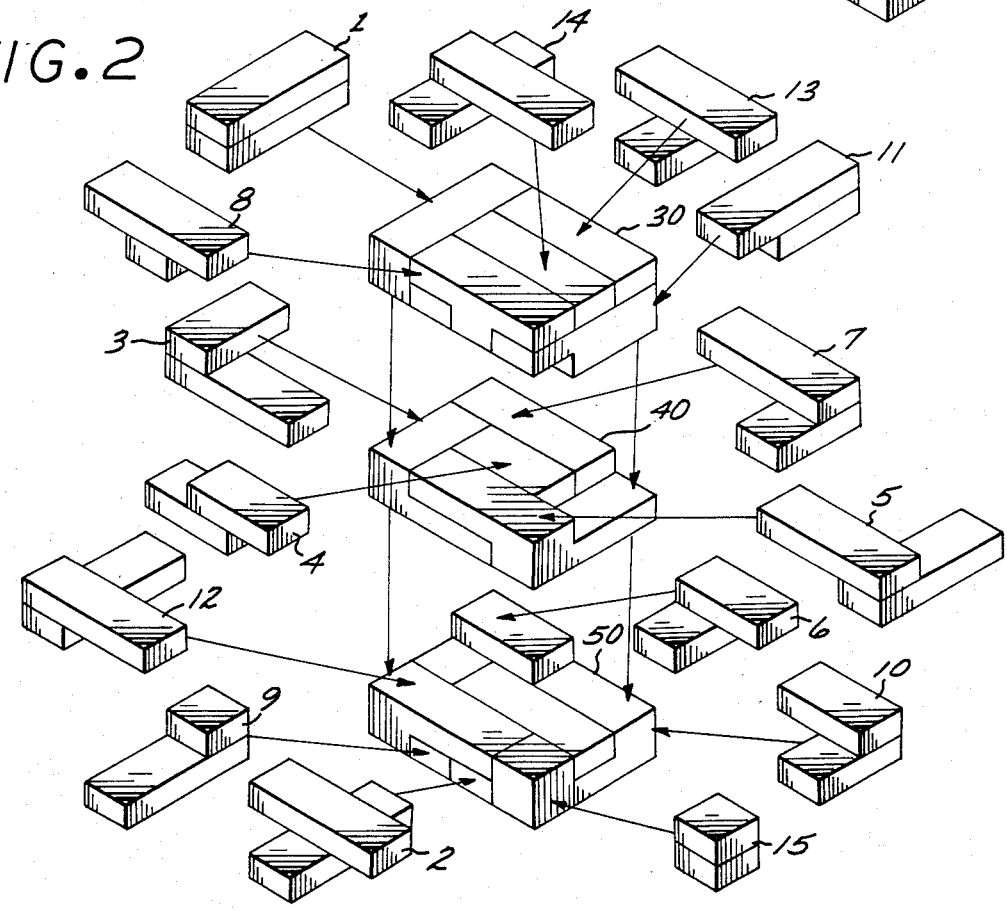
FIG. 2 is a perspective view of a $3\times4\times6$ size puzzle with an exploded view of each of its components.

FIG. 2 illustrates a perspective and exploded view of a 3×4×6 unit puzzle. To solve this problem, the player may use the 15 specific component pieces arranged in a manner such that the specific polyhedron (the combination of component sub-assemblies 30, 40, and 50) is formed.

Figure 3:
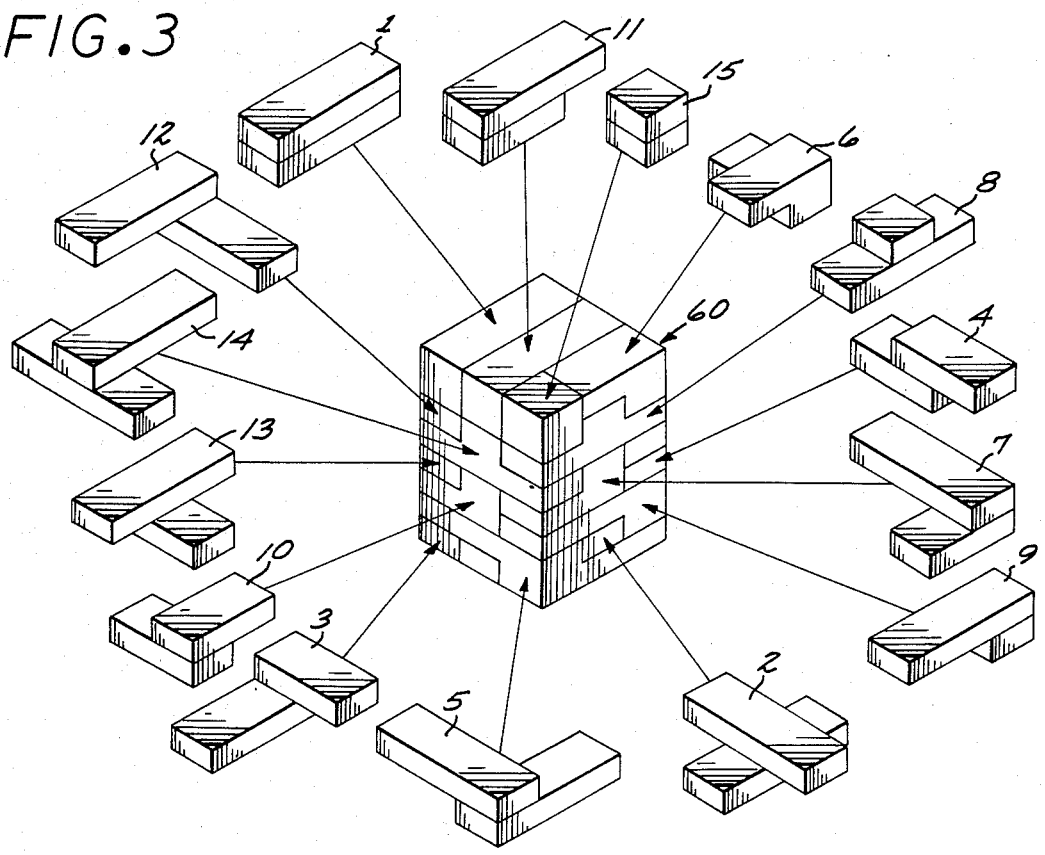
FIG. 3 is a perspective view of a $3\times3\times8$ size puzzle with an exploded view of each of its components.

In FIG. 3, a perspective and exploded view of a 3×3×8 cubic rectangular prism puzzle is shown wherein all the 15 component pieces are utilized to form the cube 60.

Figure 4:
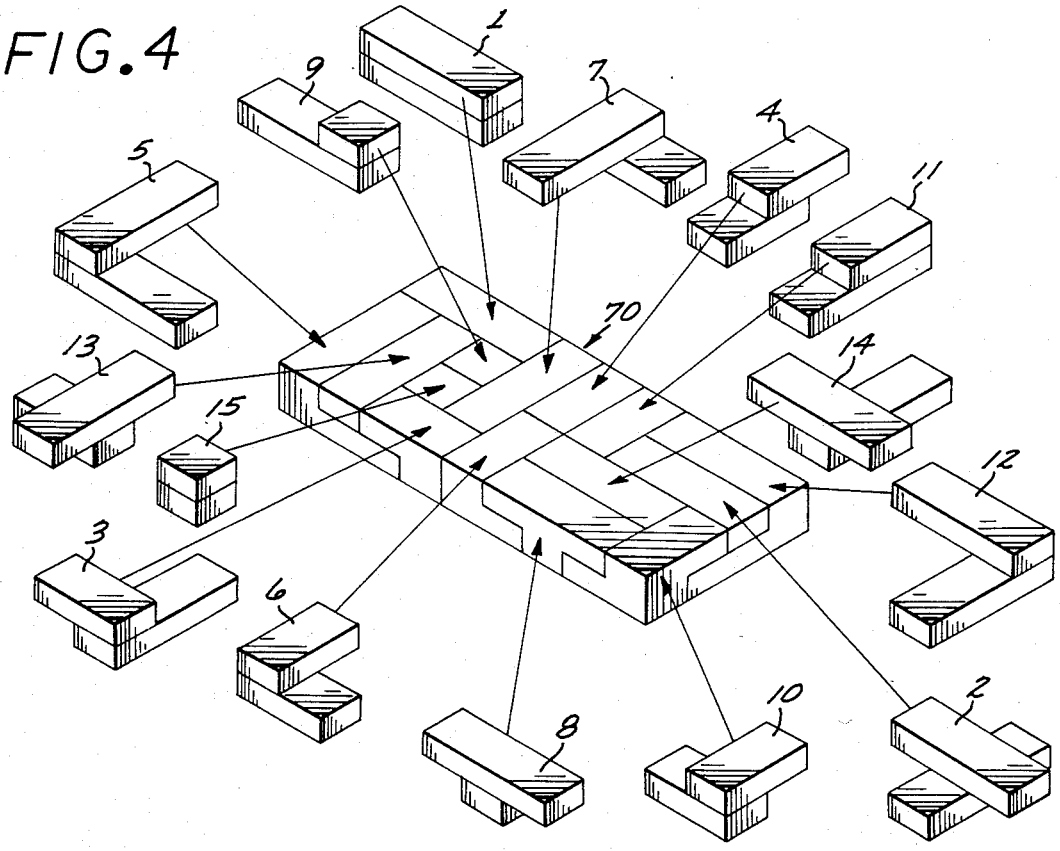
FIG. 4 is a perspective view of a $4\times9\times2$ size puzzle with an exploded view of each of its components.

In FIG. 4, a perspective and exploded view of a 4×9×2 unit puzzle is illustrated wherein all the component pieces are utilized to form a right rectangular prism 70.

Figure 5:
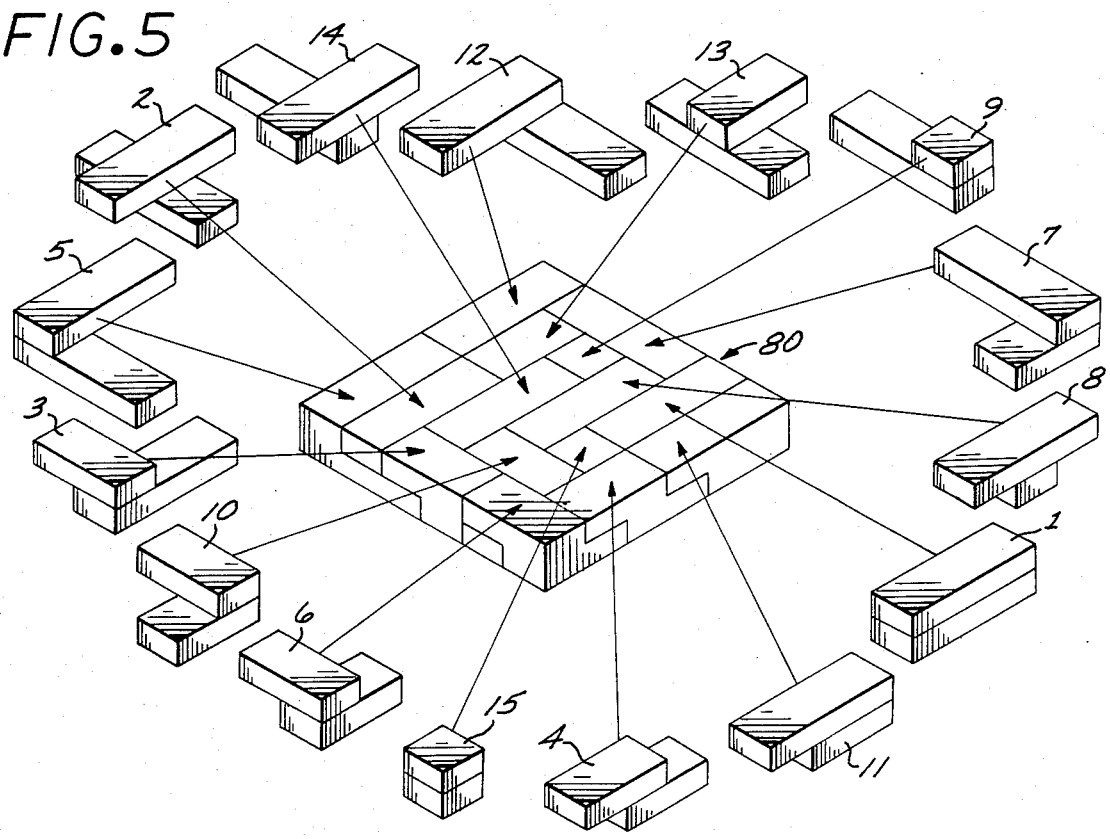
FIG. 5 is a $6\times6\times2$ size puzzle with an exploded view of each of its components.

In FIG. 5, a perspective and exploded view of a 6×6×2 unit puzzle is illustrated wherein all the component pieces are utilized to form a right rectangular prism 80.

Figure 6:
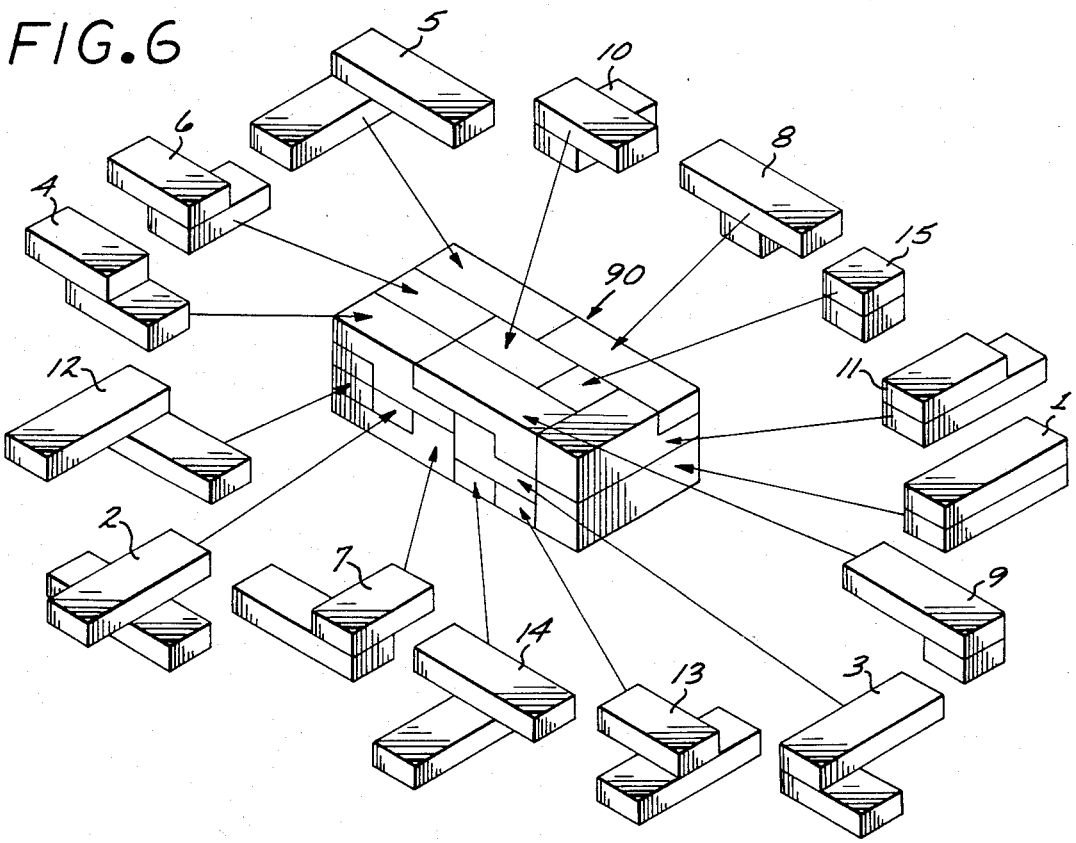
FIG. 6 is a perspective view of a $3\times6\times4$ size puzzle with an exploded view of each of the components.

In FIG. 6, a perspective and exploded view of a 3×6×4 cubic unit puzzle wherein all the component pieces are utilized to form the right rectangular prism 90.

In the preferred embodiment, each component piece comprises two separate pieces layered together by an adhesive, such as standard wood glue, although the pieces may be made from injection molded plastic in the form of a single (mono) two level block component piece. It should be noted that the glue joints have been omitted from the figures as a means of distinguishing between separate pieces and the lines between the separate layers which form each component piece.

In a specific embodiment, each unit piece has a width of approximately ¾″, a length of ¾″, and a height of approximately 0.281″. The particular height dimension allows a cube (FIG. 3) to be formed as one of the solutions. Although a square cross section piece could be utilized, the resulting solutions would deviate from the cube, a three dimensional puzzle typically having a cube as one of its solutions. Thus, by using a rectangularly shaped piece designed to have a height dimension described above to provide at least one cube solution, the overall cost of the design is substantially minimized since a smaller sized unit (and thus component) piece is required.

As set forth hereinabove, using the prime factors in formulating the length, width, or height dimensions of a puzzle solution, allows the prime factors to be shifted about to produce different shaped solutions using all the component pieces. Thus, different combinations of prime factors produce different lengths, widths, and heights thereby providing more solutions for a given number of puzzle pieces for a particular puzzle volume. Note that more solutions would be possible if more prime factors are utilized, but the puzzle unit volume would increase and correspondingly increase the cost of the puzzle. For design purposes, it has been determined that at least four prime numbers are to be utilized.

For the particular design illustrated (puzzle unit volume of 72) a 1, 2, or 3 unit length block was joined on another 1, 2, or 3 unit block. Mathematically, this indicates that 17 component pieces would be possible. However, use of all 17 pieces would provide a unit volume over 72 and thus two of the possible component pieces are not utilized in the puzzle.

Using the teachings of the present invention and by limiting the largest prime number to three (and thus the length of a piece to three units) an ideal puzzle volume (72) can be realized with substantial cost savings. It should be noted that although eight possible solutions are theoretically possible, it is beleived that the last two solutions in the 72 puzzle volume table are not capable of being assembled.

Within the framework of the foregoing example, puzzle pieces can be designed so as to optimize the difficulty of finding solutions to any of the solution shapes although increasing the difficulty of a particular shape may render impossible certain other shapes. Other ways of assembling the pieces into other than a right rectangular prisms are also possible, and more than one way of assembling each shape may also exist.

Using all the component prices to assemble each puzzle solution provides a more aesthetically pleasing effect; makes it easier to package the puzzle in different shapes; and the satisfaction of using all the pieces to form different puzzle solutions is experienced by the puzzle solver.

It is to be understood that the above described embodiment of the invention is illustrative only and that modifications thereof may occur to those skilled in the art. Accordingly, this invention is not to be regarded as limited to the embodiment disclosed herein, but is to be limited only as defined by the appended claims.

What is claimed is:

1. A three dimensional puzzle game comprising a plurality of component pieces, each of said component pieces being unique from each other, and forming two or more right rectangular prisms when assembled in particular configurations, the number of prisms being formed being dependent on the puzzle unit volume of the puzzle and the prime factors of said volume, each of said component pieces comprising units of preselected length, width and height, each component piece further comprising two layers of rectangular cross sectional material arranged in a predetermined manner with respect to each other, each layer of said material having a dimension equal to the unit width and unit height and a length equal to said unit width or multiples thereof.

2. The puzzle of claim 1 wherein all of said component pieces are utilized to form each of said different prisms.

3. The puzzle of claim 1 wherein at least five prime numbers are utilized to determine the number of rectangular prisms and wherein said prime numbers are not all equal to each other.

4. The puzzle of claim 1 wherein one of said rectangular prisms comprises a cube.

5. The puzzle of claim 1 wherein said two layers of material are adhesively joined together.

6. A three dimensional puzzle game comprising a plurality of component pieces, each of said component pieces being unique from each other, and forming two or more right rectangular prisms when assembled in particular configurations, the number of prisms being formed being dependent on the puzzle unit volume of the puzzle and the prime factors of said volume, each of said component pieces comprising units of preselected length, width and height, each component piece further comprising an integrated structure having two levels of rectangular cross sectional material arranged in a predetermined manner with respect to each other, each level having a dimension equal to the unit width and unit height and a length equal to said unit width or multiples thereof.

7. The puzzle of claim 6 wherein all of said component pieces are utilized to form each of said different prisms.

8. The puzzle of claim 6 wherein at least five prime numbers are utilized to determine the number of rectangular prisms and wherein said prime numbers are not all equal to each other.

9. The puzzle of claim 6 wherein one of said rectangular prisms comprises a cube.

* * * * *